US005285892A

United States Patent [19]

Adami et al.

[11] Patent Number: 5,285,892

[45] Date of Patent: Feb. 15, 1994

[54] SANITARY CAN CARRIERS AND MULTIPLE BEVERAGE CAN PACKAGES INCLUDING THE SAME

[75] Inventors: Arthur E. Adami, Andover, Mass.; Christopher P. Amberg, Owings Mills, Md.; William B. Pendergrass, Hanover, Pa.

[73] Assignee: Sweetheart Cup Company Inc., Owings Mills, Md.

[21] Appl. No.: 924,557

[22] Filed: Aug. 5, 1992

Related U.S. Application Data

[63] Continuation-in-part of Ser. No. 882,163, May 12, 1992, which is a continuation-in-part of Ser. No. 741,935, Aug. 8, 1991, abandoned.

[51] Int. Cl.[5] ..... B65D 71/00

[52] U.S. Cl. ..... 206/151; 206/161

[58] Field of Search ..... 206/139, 141, 145, 147, 206/148, 149, 150, 151, 156, 158, 161; 294/87.2

[56] References Cited

U.S. PATENT DOCUMENTS

| | | | |
|---|---|---|---|
| 2,884,155 | 4/1959 | Hanson | 220/23.4 |
| 3,002,612 | 10/1961 | Poupitch | 206/65 |
| 3,156,358 | 11/1964 | Randrup | 206/65 |
| 3,200,944 | 8/1965 | Rapata | 206/65 |
| 3,202,448 | 8/1965 | Stern et al. | 294/87.2 |
| 3,224,576 | 12/1965 | Whiteford | 206/65 |
| 3,250,564 | 5/1966 | Stern et al. | 206/151 |
| 3,300,041 | 1/1967 | Fuller | 206/65 |
| 3,302,854 | 2/1967 | Midgley et al. | 229/43 |
| 3,310,334 | 3/1967 | Murphy | 294/87.28 |
| 3,317,234 | 5/1967 | Burford | 294/87.2 |
| 3,331,500 | 7/1987 | Poupitch | 206/65 |
| 3,346,106 | 10/1967 | Gooding | 206/65 |
| 3,350,131 | 10/1967 | Tanzer | 294/87.2 |
| 3,595,425 | 7/1971 | Eicboltz | 220/20 |
| 3,744,626 | 7/1973 | Dreyfus | 206/65 |
| 3,752,305 | 8/1973 | Heyne | 206/65 |
| 3,778,096 | 12/1973 | Smith | 294/87 |
| 3,784,002 | 1/1974 | Owen | 206/158 |
| 3,871,699 | 3/1975 | Hatfield | 294/87.2 |
| 3,874,502 | 4/1975 | Weaver | 206/145 |
| 4,136,772 | 1/1979 | Mascia et al. | 206/199 |
| 4,139,094 | 2/1979 | Berry et al. | 206/146 |
| 4,215,525 | 8/1980 | Nigrelli | 53/579 |
| 4,332,121 | 1/1982 | Nigrelli | 53/251 |
| 4,512,497 | 4/1985 | Grusin | 220/366 |
| 4,685,275 | 8/1987 | Nigrelli, Sr. | 53/566 |
| 4,712,680 | 12/1987 | Panazzolo | 206/149 |
| 4,721,222 | 1/1988 | Haythornthwaite | 206/151 |
| 4,801,773 | 1/1989 | Henlon | 219/10.55 |
| 4,805,372 | 2/1989 | Nigrelli | 53/48 |
| 4,911,290 | 3/1990 | Karabedian et al. | 206/145 |
| 4,940,158 | 7/1990 | Farrell et al. | 220/268 |
| 4,953,743 | 9/1990 | Dart et al. | 220/20 |
| 4,982,551 | 1/1991 | Nigrelli, Sr. | 53/55 |
| 5,027,586 | 7/1991 | Ramaker | 53/458 |

FOREIGN PATENT DOCUMENTS

| | | | |
|---|---|---|---|
| 70179 | 3/1992 | Canada . | |
| 2621298 | 4/1989 | France | 206/145 |
| 0938683 | 10/1963 | United Kingdom | 206/151 |

OTHER PUBLICATIONS

"Beverage Carrier Passes White Glove Test", TECH-PAK, May 20, 1991.

*Primary Examiner*—Jimmy G. Foster
*Attorney, Agent, or Firm*—Nixon & Vanderhye

[57] ABSTRACT

Can carriers are provided with upwardly protruding can-receiving members having oppositely paired can-receiving recesses and can-stacking platforms. The can-receiving recesses each are defined by an annular locking ring is joined to a protective inverted cup-shaped cover wall sized and configured to closely correspond to the top bead of a conventional can. The locking ring thus seats below the top bead of the can thereby removably locking the can to the can carrier. A camming surface downwardly and radially outwardly extends from the locking ring and assists during the forcible insertion of a can into the can-receiving recess by urging the locking ring to bend and/or flex radially outwardly a sufficient amount to allow for the diametrically larger top bead to pass thereby. Once the top bead is seated in the can-receiving recess, the locking ring will again resiliently return to its normal state. Paired finger openings are preferably provided in association with a raised pad region. Structurally reinforcing rib elements may also be provided with the pad regions.

38 Claims, 9 Drawing Sheets

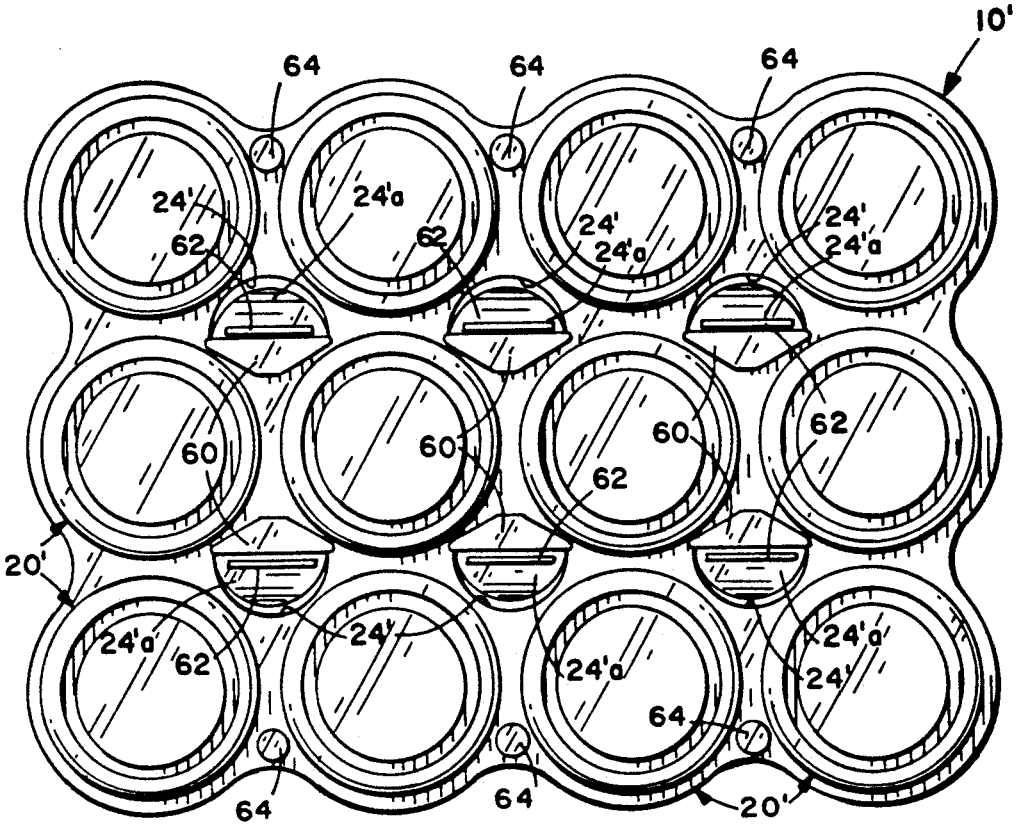
FIG. 5
FIG. 6
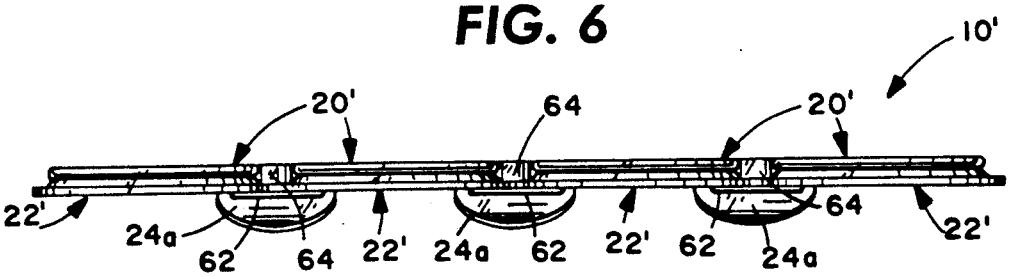

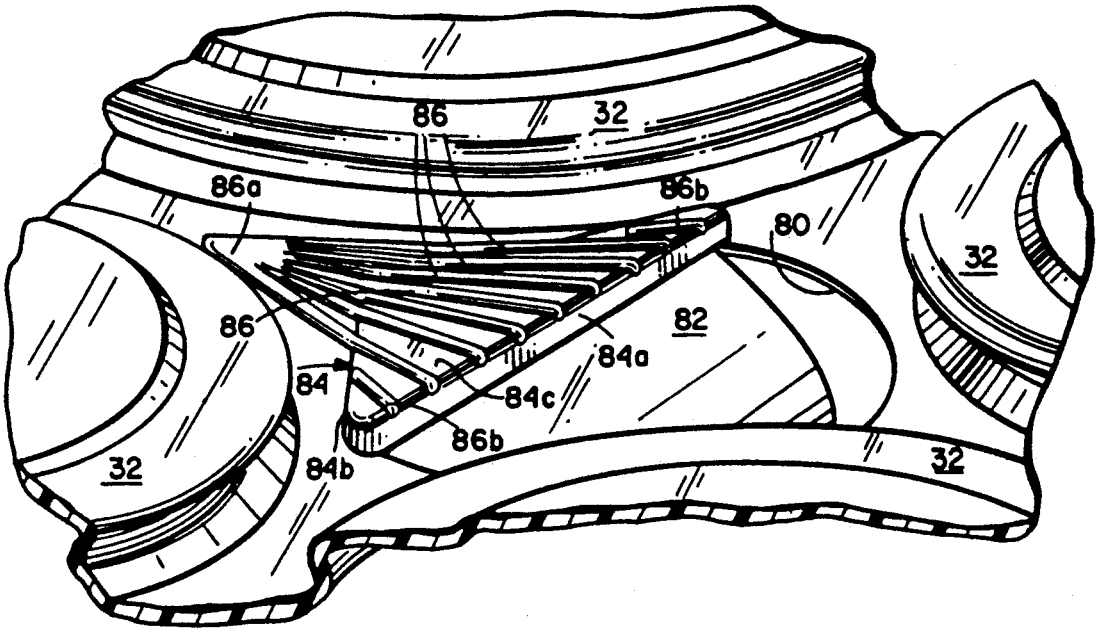
FIG. 8
FIG. 9
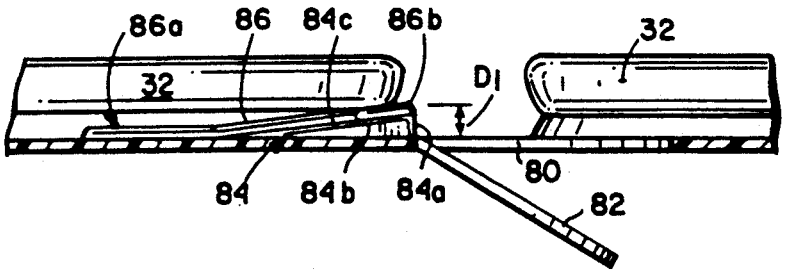

SANITARY CAN CARRIERS AND MULTIPLE BEVERAGE CAN PACKAGES INCLUDING THE SAME

CROSS-REFERENCE TO RELATED APPLICATIONS

This application is a continuation-in-part of copending and commonly owned U.S. patent application Ser. No. 07/882,163 filed May 12, 1992, which in turn is a continuation-in-part of commonly owned U.S. patent application Ser. No. 07/741,935 filed on Aug. 8, 1991 (now abandoned), and is related to commonly owned, copending U.S. design patent application Ser. No. 07/924,655 filed Aug. 5, 1992, which design application is a continuation-in-part of copending commonly owned U.S. design application Ser. No. 07/882,164 filed on May 12, 1992, which in turn is a continuation-in-part of U.S. design application Ser. No. 07/741,942 filed on Aug. 8, 1991, the entire content of each above-noted application being expressly incorporated hereinto by reference.

FIELD OF THE INVENTION

The present invention generally relates to devices adapted to removably hold a number of cans (i.e., so-called "can carriers"). More specifically, the present invention relates to can carriers having plural upwardly protruding members defining a corresponding number of oppositely paired can-receiving recesses and can-stacking platforms arranged in a selected geometric array of cans.

BACKGROUND OF THE INVENTION

Carriers for containers (e.g. beverage cans or the like) are presently configured in the form of an integral array of resilient rings corresponding to the number of containers to be supported. Each of the individual rings in the array has an internal shape which is smaller than the external diameter of the container to thereby create a relatively tight (but releasable) friction fit so as to support the can around its neck at a position below the can's upper bead or chime.

One problem associated with conventional ring carriers is that they provide little protection for the cans from the environment in which they are stored. Oftentimes, unsightly dirt and debris from warehouses, stores or the like, collect on the tops of the cans creating a potentially unsanitary condition and a displeasing aesthetic effect for the consumer. This may lead the consumer to make another selection thus resulting in a lost sale and the perpetuation of the unsightly cans in the retailer's display. Of course if a consumer selects a package having dirty and/or soiled tops, the consumer must first clean the container before the contents in the can may be enjoyed.

Another problem associated with these conventional ring carriers is that they are typically quite flexible and oftentimes do not adequately stabilize the cans when carried. In this regard the cans carried by conventional ring carriers may splay outwardly when the package is lifted. Therefore, when stacking the cans (e.g. for display purposes at a retail store) both hands usually must be used to ensure the package of cans is seated properly on top of the preceding package of cans in the stack. In addition, when a consumer carries cans supported by a ring carrier, the ring carrier may be subjected to external stresses caused by the normal swinging and swaying associated with natural walking movements. These stresses can (and oftentimes do) cause the rings to stretch and expand thereby loosening the friction fit which is exerted against the cans. A condition is thus created whereby one or more cans may separate from the ring carrier. In addition, after the cans have been removed from the ring carrier, it is quite difficult to reinsert the cans so as to enable the consumer to reuse the carrier, for example, to allow the cans to be more easily transported to a recycling center.

One solution that has been proposed in the art (as represented by U.S. Pat. No. 3,200,944) is to thermally draw a thin plastic film around the tops of the containers to provide a sanitary covering. However, this thin plastic film may not provide sufficient strength or support when the containers are transported from one location to another as there is no reliable means locking the cans to the carrier. In addition, no specific structure is provided which enables the cans of subsequent packages to be stackably seated upon a preceding similar package of cans. Therefore, the cans in the stack of packages may shift and slide relative to one another increasing the possibility that the stack of packages will collapse.

Another solution which has been proposed in the art (as represented by U.S. Pat. No. 4,911,290) is to provide a series of rings (corresponding to the commercial unit to be sold) and apply a plastic film over the top of the ring array thereby forming a flat laminate. The cans are inserted into the openings so as to allow the chime or bead to rest upon the upper portion of the ring. The plastic film that is applied over the top of the ring array serves to hold the cans securely against the rings in addition to providing a sanitary covering for the tops of the cans. However, the carrier appears to have sacrificed the traditional interlocking nesting features of the cans in order to provide a sanitary covering.

What has been needed in the industry, therefore, is an improved can carrier which provides not only a measure of sanitary protection for the can tops, but also has enhanced structural integrity so as to insure that the cans will not become detached inadvertently from the carrier, while providing means whereby the cans may reliably be nested, and thereby stacked one upon the other.

SUMMARY OF THE INVENTION

The present invention is embodied in novel devices for reliably transporting, stacking and safeguarding containers (e.g. beverage cans or the like). The preferred can carriers of this invention are generally planar sheet-like structures having a plurality of integral upwardly protruding members creating a corresponding number of oppositely paired can-receiving recesses and can-stacking platforms. The paired platforms and recesses are arranged in an orderly manner so as to correspond to a selected geometric array of cans that may be desired, for example for purposes of retail sales. Thus, the can carriers of this invention may be embodied in virtually any commercially suitable geometric array so as to package any desirable number of cans (e.g. six, eight, twelve, eighteen, twenty, twenty-four, etcetera). In addition, the can-receiving recesses of the can carrier provide a protective cover coextensive with the top of each can so as to thereby provide a measure of sanitary protection.

The can carrier of the present invention includes an annular locking ring located within each of the can-receiving recesses to retain the cans in a tight interfitting relationship with the carrier. This annular locking ring is resiliently displaceable between two positions, a normal locked position and a displaced position. When the can is forcibly inserted into one of the can-receiving recesses the chime or bead, located on the periphery of the top of the can, engages a camming surface on the lower edge of the annular locking ring, thereby causing the locking ring to be radially displaced outwardly. As the can continues to be inserted into the recess, the annular locking ring rides around the chime or bead of the can and then resiliently returns to its normal locked position once the bead has been fully seated in the recess. The annular locking ring when in its normal position will therefore surround the can about its neck, thereby gripping the can at a point just below the bead or chime to presumably "lock" the can onto the carrier.

The can carrier of the present invention is also most preferably provided with can-stacking platforms oppositely paired with the can-receiving recesses. The can-stacking platforms define recessed stacking surfaces which are sized and configured so as to receive the bottoms of conventional beverage cans (which are generally tapered inwardly).

A depending skirt may also be provided as an integral part of the can carriers according to the present invention. This depending skirt, when present, is disposed about the can carrier's periphery and is provided so as to further inhibit the cans from splaying as well as to increase the rigidity of the can carrier itself.

An outwardly extending peripheral flange may integrally be formed on the lower portion of the depending skirt so as to increase the rigidity of the skirt and thereby contribute improved can stability during transport. Apertures may be formed in the can carriers of this invention to allow the carrier to be grasped and carried manually. The apertures may be of any desired size and/or geometric configuration which allows the can carrier to be grasped manually. Preferably, however, the apertures are D-shaped in configuration and are formed by partially cutting the top wall of the can carrier along an arcuate path, then folding the cut portion inwardly along a straight edge.

The apertures are most preferably provided with adjacent raised generally triangular pad regions which provide a measure of comfort to the user when the can-carrier of this invention is transported. The pad regions will include a base wall disposed adjacent to the aperture along the aperture's interior edge and a pair of side walls which extend inwardly laterally (i.e., toward the can-carrier's central region) relative to the aperture and converge toward one another so as to form a generally triangularly shaped structure in plan view. Most preferably the raised pad region is provided with at least one reinforcing rib element to structurally reinforce an area interiorly adjacent to the aperture which is subject to substantial stress during manual transport. In this regard, the structural reinforcement may be in the form of a rib element located adjacent to the base wall of the raised pad region and/or may be in the form of a number of rib elements which originate near a central region of the can-carrier and divergingly extend toward the pad region's base wall.

Further aspects and advantages of the present invention will become more clear after careful consideration is given to the detailed description of the preferred exemplary embodiments thereof which follow.

BRIEF DESCRIPTION OF THE DRAWINGS

Reference hereinafter will be made to the accompanying drawings where like reference numerals throughout the various figures denote like structural elements and wherein.

Figure 7:
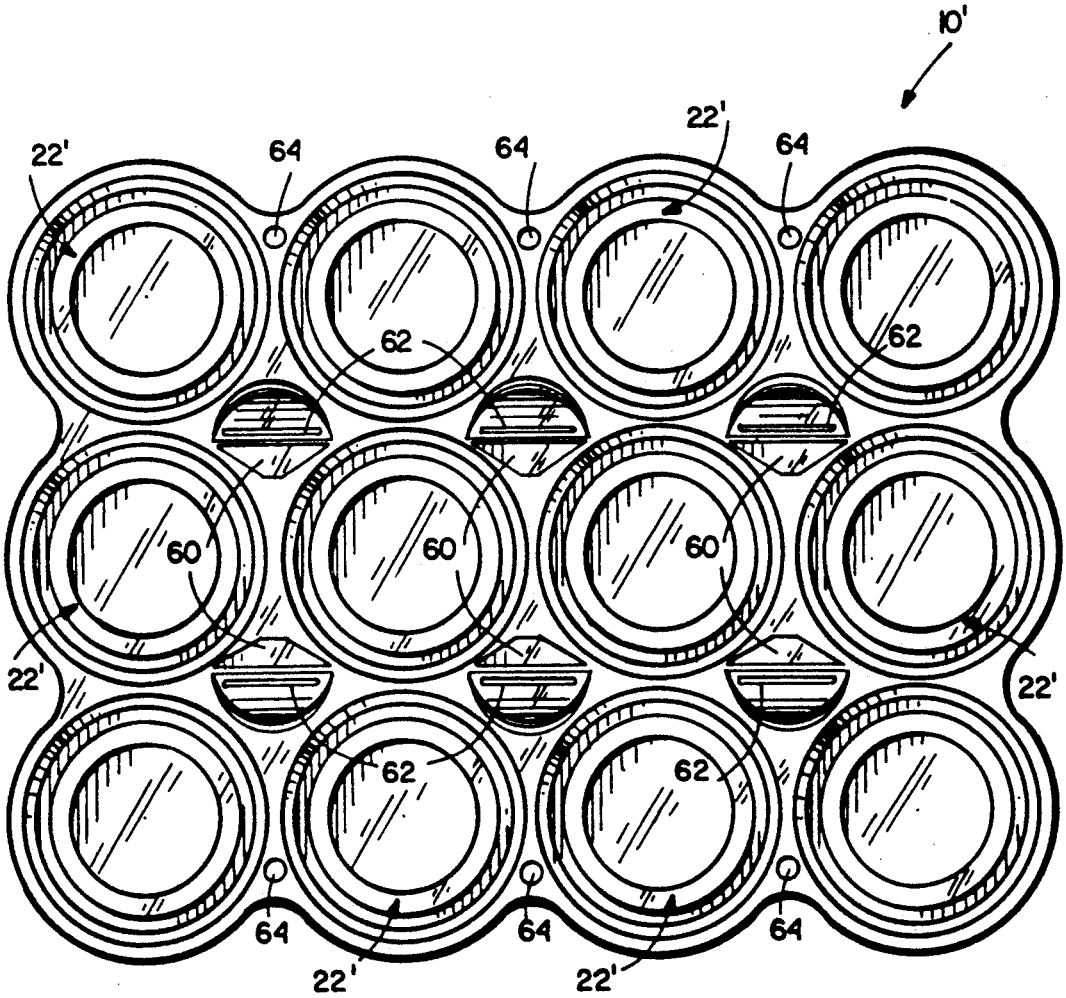
Figure 10:
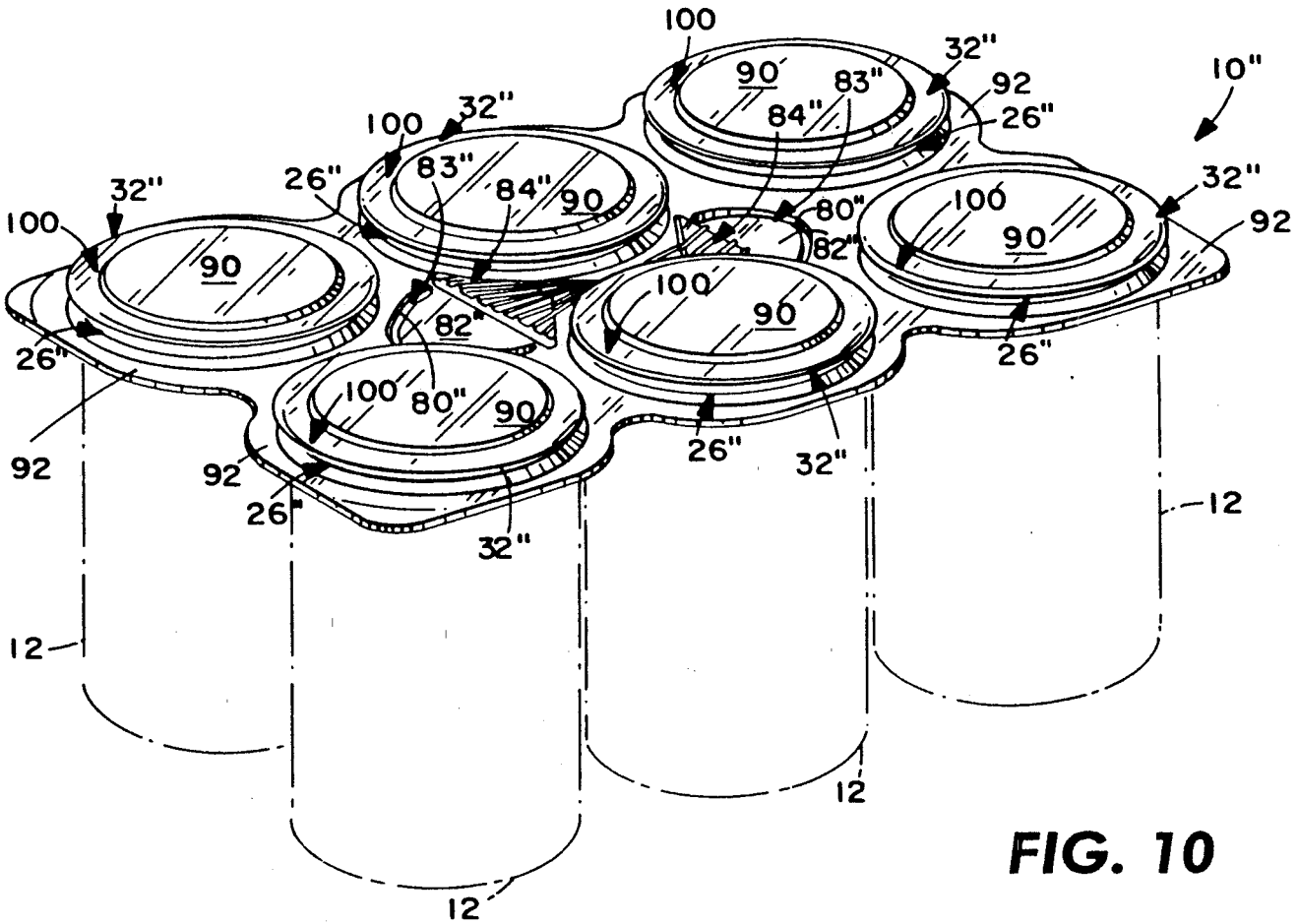
Figure 11:
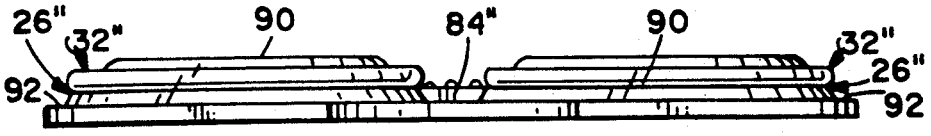
Figure 12:
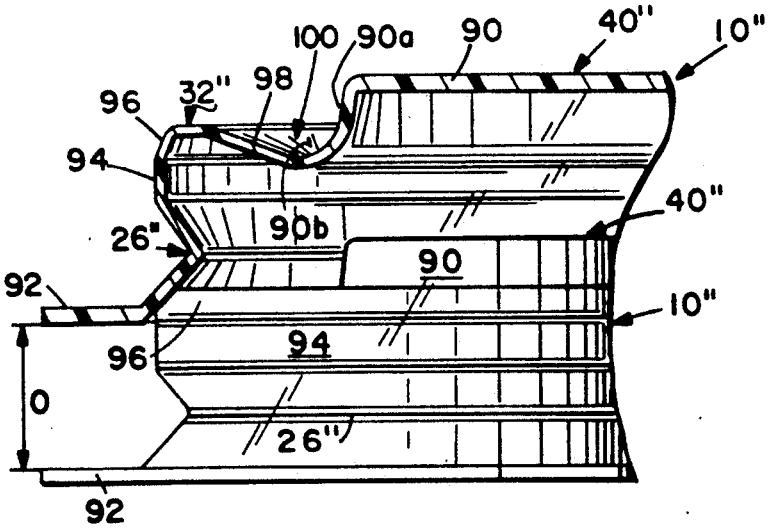

FIGS. **4*a*–4*c*** each show a partial section of a can-receiving recess and collectively depict a sequence whereby a can is being forcibly coupled therewith;

FIG. 5 is a top plan view o another embodiment of a stackable can carrier according to the present invention;

FIG. 6 is a front elevational view of the can carrier shown in FIG. 5;

FIG. 7 is a bottom plan view of the can carrier shown in FIG. 5;

FIG. 8 is a representative enlarged perspective view of another embodiment of the carrying aperture and associated structure;

FIG. 9 is a partial cross-sectional elevational view of the aperture embodiment depicted in FIG. 8;

FIG. 10 is a perspective view showing another embodiment of the can carrier according to this invention;

FIG. 11 is an end elevation view of the can carrier embodiment shown in FIG. 10; and FIG. 12 is a side elevation view, partly in section, showing the manner by which can carriers of the embodiment shown in FIG. 10 may be stacked.

DESCRIPTION OF THE PREFERRED EXEMPLARY EMBODIMENTS

Figure 1:
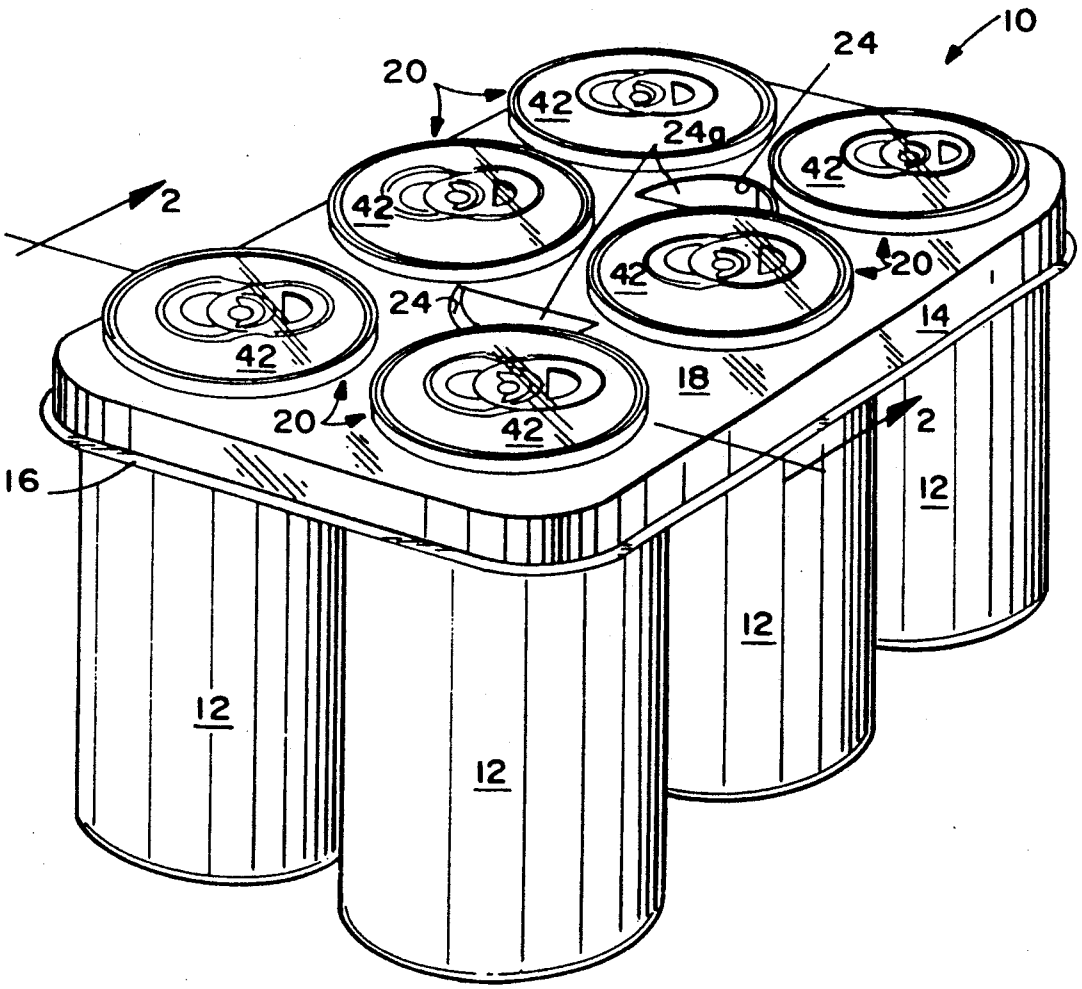
FIG. 1 is a perspective view of a package of beverage cans retained in a selected configuration by means of a can carrier according to the present invention.

The principal structural aspects according to one embodiment of the present invention are illustrated in accompanying FIG. 1. As is shown, a can carrier (generally designated by reference numeral 10) dependently supports a plurality of cans 12 in a particular geometric array suitable for retail sale. Can carrier 10 shown in accompanying FIG. 1 includes a peripherally extending depending skirt 14 which stabilizes the cans 12 and thereby further reduces the possibility that the cans 12 will splay outwardly relative to carrier 10 when being transported. As a result, the cans 12 are maintained substantially in a side-by-side relationship. Depending skirt 14 may also include an outwardly extending peripheral flange 16 which serves to further rigidify the depending skirt 14 and thereby increase its can stabilizing function.

Figure 3:
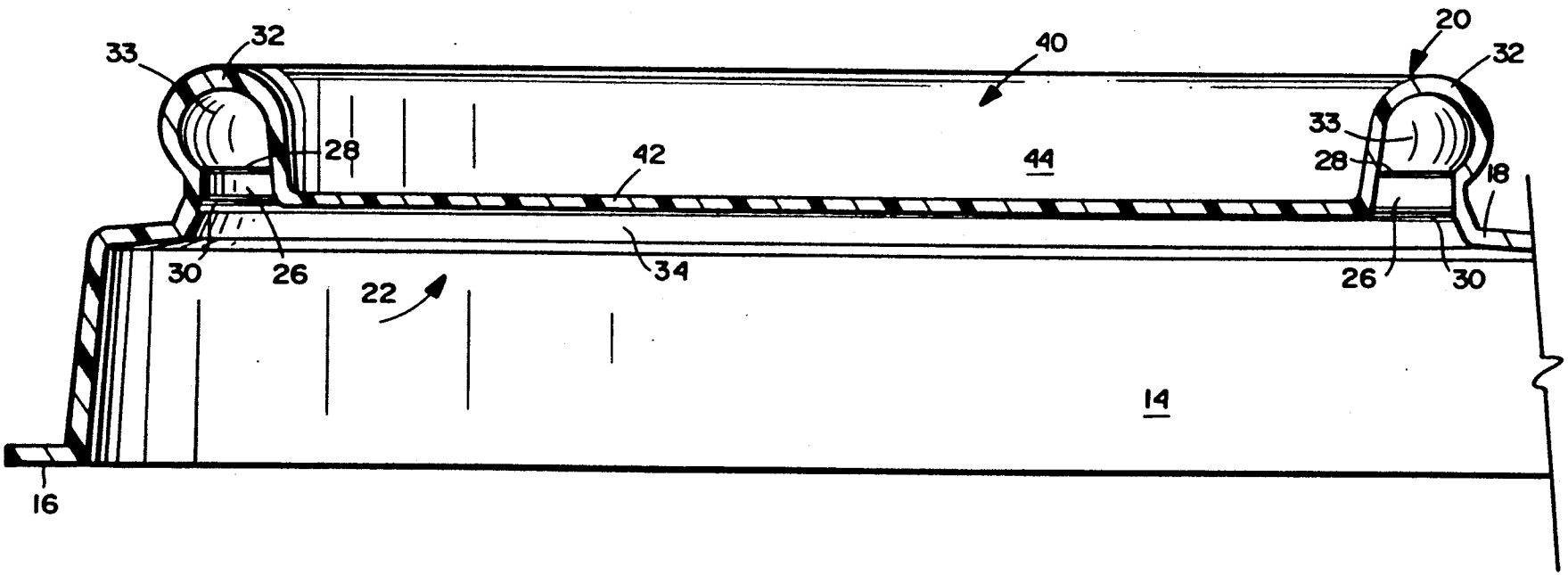
FIG. 3 is a cross-sectional partial elevational view showing, in a greatly enlarged manner for purposes of clarity, a representative can-receiving recess and can-stacking platform associated with the can carrier of this invention.

Can carrier 10 is formed of a generally planar sheet 18 having a plurality of integral can-receiving members 20 protruding upwardly therefrom so as to establish a corresponding number of can-receiving recesses 22, a representative one of which is depicted in greatly enlarged manner for clarity of presentation in accompanying FIG. 3. Can-receiving members 20 are arranged in a particular array so as to maintain cans 12 in a side by side relationship. While FIG. 1 illustrates a conventional 2×3 can array (i.e. so-called "six pack") it is appreciated that other m×n can arrays may be accommodated by the present invention, (e.g. 4×3, 6×3, 5×4, 6×4, etcetera), as well as concentric circular can arrays.

The planar sheet 18 defines opposed generally D-shaped finger apertures 24 so as to assist the consumer in lifting and transporting the cans 12. The finger apertures 24 are formed by partially cutting through the plastics sheet material forming the can carrier 10 so as to provide a flap portion 24*a* which is integrally hinged along one of its sides to the can carrier sheet.

As is perhaps best seen in accompanying FIG. 3, can-receiving recesses 22 of carrier 10 are provided with an annular locking ring 26 which is established between upper and lower annular edges 28 and 30, respectively. Annular locking ring 26 is provided so as to secure cans 12 within can-receiving recess 22 of carrier 10.

A protective inverted cup-shaped cover wall 32 is integrally attached to the upper edge 28 of locking ring 26 so as to safeguard the top of cans 12 from contaminants which typically collect on can tops while in storage. The cover wall 32 itself defines an annular channel 33 having a cross-section in close conformance to the top bead TB of can 12. A camming surface 34 is integrally attached to the lower edge 30 of annular locking ring 26 so as to provide a surface against which the rolled top bead TB of cans 12 will be engaged when forcibly inserted within the can-receiving recesses so as to responsively assist in urging the locking ring 26 to radially expand (due to resilient bending and/or flexion occurring at or near the upper and lower edges 28 and 30, respectively).

Each of the can-receiving recesses 22 is oppositely paired with a can-stacking platform 40. As is seen in FIG. 3, the can-stacking platform 40 includes a bottom generally planar platform wall 42 integrally joined to a circumferential side wall 44 which, in turn, is integral with the cover wall 32. The platform wall 42 is thus recessed relative to the uppermost extent of the cover wall 32 so as to receive the tapered annular bottom region TBR of the cans 12 (see FIG. 2). In such a manner, the tapered bottom regions TBR associated with cans 12 can be nested within the can-stacking platforms 40 of a subjacent can-carrier so as to allow a number of can packages (i.e., the combination of a number of cans 12 held by a can carrier 10) to be stacked one on top of the other. It will be also be appreciated that the bottom platform wall 42 is coextensive with the top of the can 12 when removably coupled to the can carrier 10 according to this invention thereby providing a protective cover thereover.

In use, a rolled top bead TB associated with a can 12 may forcibly be inserted into a coupled relationship with a respective one of the can-receiving recesses 22 so that the can is dependently locked to the can carrier 10 as described previously. In this connection, the rolled top bead TB of the can 12 will initially come into contact with the camming surface 34 when it is first being inserted into the can-receiving recess 22 as shown in accompanying FIG. 4*a*. The camming surface 34 provides an enlarged entranceway into the annular locking channel 33 of the cover wall 32 as well as urging the locking ring to be displaced radially outwardly upon further insertion of the can 12 as shown in FIG. 4*b*. It will especially be observed in FIG. 4*b* that, as the larger diameter (i.e., relative to the diameter of the lock ring 26) top bead TB of can 12 is forcibly inserted into the can-receiving recess 22, the resiliency of the plastics material from which the can carrier 10 is made allows the lock ring 26 to bend or flex generally at its upper and/or lower edges 28, 30. As mentioned previously this bending/flexion is facilitated initially due to the positioning of the downwardly radially extending camming surface 34 relative to the locking ring 26.

Figure 4C:
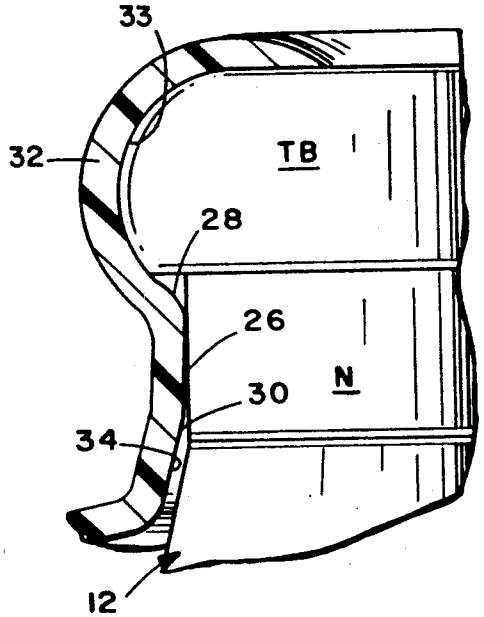
Figure 4B:
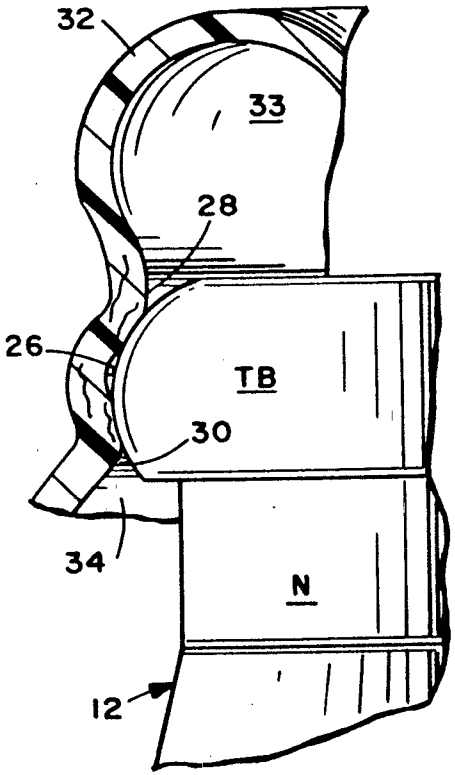
Figure 4A:
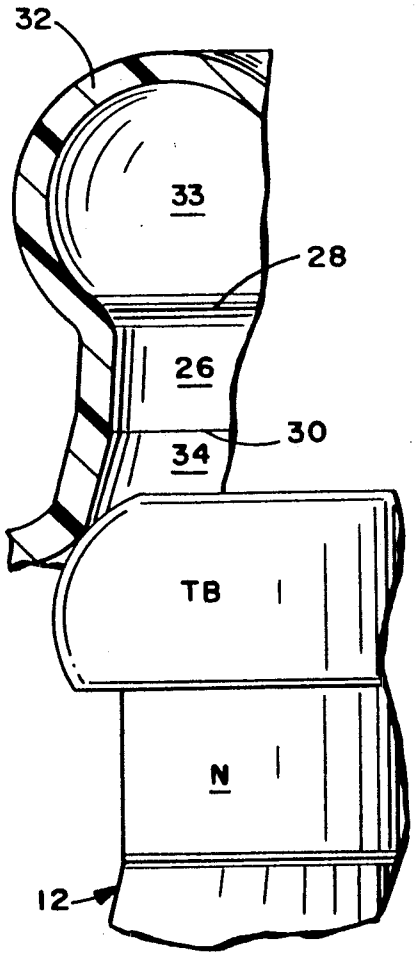

Once the can 12 has been forced to the extent whereby the rolled top bead TB is seated within the annular channel 33 defined by the cover wall 32, the inherent resiliency of the locking ring 26 will cause it to again return to its "normal" state as shown in FIG. 4*c*. That is, the locking ring 26 will return to its smaller diameter (i.e., relative to the diameter of the can 12 at its top bead TB) configuration thereby being seated just below the top bead TB and adjacent the neck N of the can 12. In this manner, the can 12 is coupled to the can carrier 10 to allow its transport with similarly coupled cans, but can be removed when desired by sufficient force.

The can carrier according to this invention can be made from a number of thermoplastic materials (for example, polyethylenes, polyalkylene terephthalates, and the like) using virtually any conventional thermoforming technique well known in the plastics fabrication art. Preferably, the can carriers 10 according to this invention are fabricated using sheets of thermoplastic material which are then thermoformed using appropriately configured molds. The particular thermoplastics material that is selected must, of course, exhibit shape-retention under normal ambient conditions as well as having shape-memory characteristics so as to allow for the cans to be inserted into the can carrier and be securely held thereby to an extent that reliable transport of the cans 12 may be achieved. However, the cans 12 may be removed relatively easily from the can-receiving recesses 22 as described above without substantial permanent deformation occurring.

Another embodiment of a can carrier 10' according to the present invention is depicted in accompanying FIGS. 5–7. As is seen, the can carrier 10' is essentially similar in most respects as compared to the can carrier 10 described above with reference to FIGS. 1–3. Thus, similar structural elements to those already described will be identified by the same reference numerals in FIGS. 5–7, but will be further designated by a prime (') identifier. The description of these like structural elements will therefore not be repeated here.

The can carrier 10' shown in FIGS. 5–7 is depicted as being adapted to carrying a 3×4 array of cans (i.e., a so-called "twelve-pack"). However, as noted previously the can carrier 10' may be configured as desired to carry any other suitable array of cans.

Figure 2:
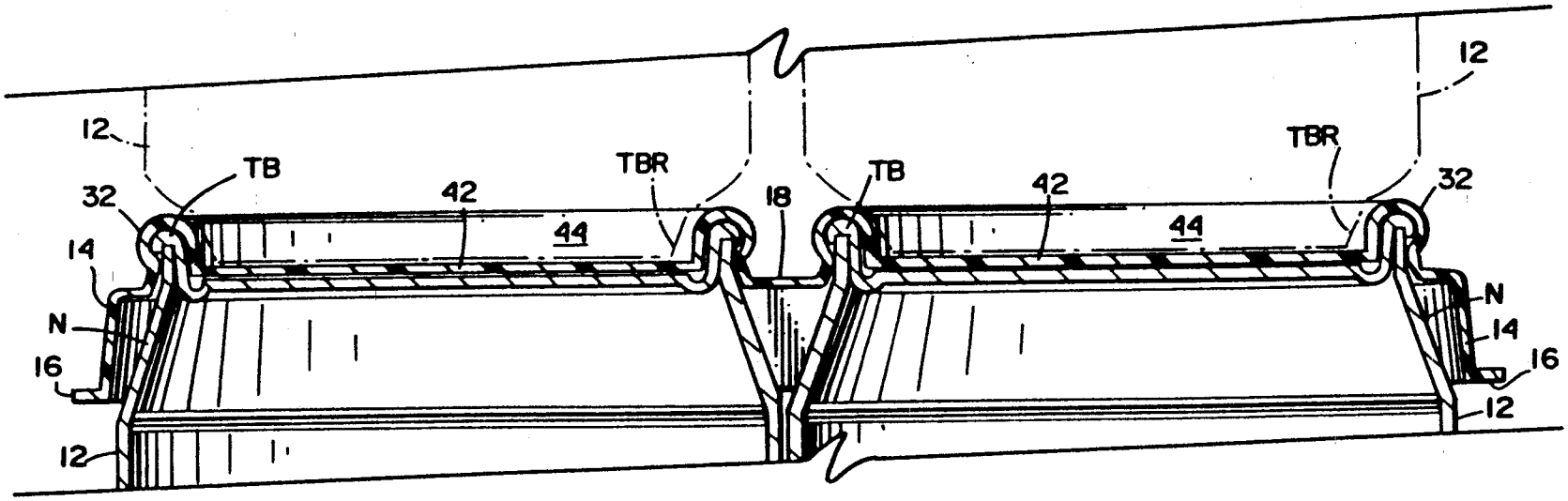
FIG. 2 is a cross-sectional partial elevational view as taken along line 2—2 in FIG. 1 showing the manner in which the can tops are frictionally retained within the respective can-receiving recesses and the manner in which the tapered can bottoms are positioned within the can-stacking platform of the present invention.

One principal difference in the embodiment of the can carrier 10' shown in FIGS. 5–7 as compared to the can carrier 10 shown in FIGS. 1–3 is that the bottom edges of cans may be mated with an annular ring 50 defined between an inner circular plateau 52 and annular cover wall 32'. Thus, a greater measure of stability of cans in a stack may be achieved.

Another principal difference in the embodiment of the can carrier 10' in FIGS. 5–7 as compared to the can carrier 10 described above with reference to FIGS. 1–3 is the provision of raised integral pad regions 60 located interiorly adjacent to each of the D-shaped finger openings 24'. The pad regions 60 are raised above the plane of the plastics sheet forming the can carrier 10' to a height which is dimensionally less than the height of the cover walls 32 (preferably about one-third the dimensional height of the cover walls above the plane of the plastics sheet forming the can carrier 10'). As a result, the raised pad regions 60 serve to provide increased comfort to a person's finger is inserted into the D-shaped openings 24' when the can carrier 10' is being transported with a complement of cans (not shown in FIGS. 5-7 for clarity of presentation).

The raised pad regions 60 are essentially comprised of a base wall **60*a* (see FIG. 5) which is disposed interiorly laterally adjacent to a defining edge of a respective finger opening 24'. A pair of side walls 60*b* extend from the ends of the base wall 60*a* and inwardly (e.g., relative to a central region of the can-carrier 10') converge toward one another so as to establish in plan view the generally triangular shape of the pad regions 60**.

Further comfort during manual transport of a fully loaded can-carrier 10' is provided by means of a raised rib 62 extending parallel to the integral hinge juncture of the flap **24*a'*. The rib 62 also imparts added strength to the hinge juncture so as to prevent the sheet of plastics material forming the can carrier 10' form tearing under the weight of the cans when transported. Although the rib 62 is depicted as being formed integrally with the flap 24*a'*, it could likewise be formed integrally with the raised pad region 60 and extend parallel to the hinge juncture, for example, as part of the base wall 60*a* and/or as part of the upper wall of the raised pad region 60**.

The can carrier 10' is also provided with a number of integral protruding studs 64 which extend upwardly from the plane of the plastics sheet forming the can carrier 10' to an extent at or just slightly below the plane established by the platforms 20' The studs 64 serve to allow partial nesting of the platforms 20' of subjacent carrier within the recesses 22' of another carrier when the can carriers 10' are stacked one one top of the other (e.g., during manufacture and/or packaging operations) sufficient to prevent lateral slippage of the can carriers 10' relative to one another. However, the studs 64 will maintain slight separation (i.e., will prevent complete nesting of platforms 20' within recesses 22' of another carrier) so that the can carriers 10' may more easily be separated from one another when desired by automated machinery, for example.

The individual cover walls 32 may be surrounded by a perforated region (some of which are noted generally by reference numeral 66 in FIG. 5) so as to allow individual cans with their protective covers in place to be removed from the remaining cans associated with the carrier 10'. This feature of the present invention is particularly desirable to accomodate single can retail sales while at the same time, affording the consumer a measure of sanitary protection due to the continued presence of that portion of the can carrier 10' which covers the can top.

Accompanying FIGS. 8 and 9 show an alternative embodiment of the finger-openings and associated structure which may be employed in the can-carriers of this invention. As will be noted, the finger openings 80 are generally D-shaped and are provided with a flap member 82 joined along a hinge juncture adjacent the raised based wall **84*a* of the pad region 84. As is shown in FIG. 9, the base wall extends a dimension D1 which is less than the height dimension of the cover wall 32**.

The raised pad region 84 includes a pair of side walls **84*b* which extend laterally inwardly (e.g., towards a center region of the can carrier) from the terminal ends of the base wall 84*a*. The side walls 84*b* converge toward one another thereby imparting a generally triangular shape to the pad region 80. It will also be observed that the top wall 84*c* of the pad region slopes downwardly away from the base wall 84*a* thereby giving the pad region a wedge-shaped appearance in profile (see FIG. 9**).

A number of rib elements 86 are integrally provided with the pad region 84 so as to enhance the structural integrity of the pad region 84 which is susceptible to substantial stress when a fully loaded can carrier is transported via the finger openings 80. In this regard, it will be observed that the rib elements 86 radially emanate from an apex juncture region **86*a*, and thus diverge relative to one another between that juncture region 86*a* and the base wall 84*a*. This radial divergence of the rib elements 86 thus also serves as a tactile guide structure to assist the user in locating the adjacent finger opening 80. A pair of discrete rib elements 86*b* may be positioned along the upper wall 84*c* of the pad region 84 near the terminal ends of the base wall 84*a*** so as to strengthen such end regions.

Accompanying FIGS. 10-12 illustrate another embodiment of a can carrier according to this invention. In this connection, the can carrier 10" illustrated in FIGS. 10-12 is somewhat similar to the can carriers 10 and 10' discussed previously (and thus similar structural elements have been labelled with the same reference numeral) in that a cover wall 32" is provided so as to safeguard the tops of the cans 12 from contaminants. One principal feature of this invention is that the can stacking platform 40" includes a central platform wall 90 which is vertically raised above the uppermost extent of the cover wall 32" (see FIG. 12.

The can carrier 10" is also provided with a generally V-shaped (in cross-section) locking ring 26" which is integrally connected to a planar stiffing flange region 92 extending outwardly therefrom. As can especially be seen in FIG. 12, the cover wall 32" is itself integrally connected to the V-shaped locking ring 26" by means of an annular vertical side wall 94. A bevelled shoulder wall 96 is positioned above the annular side wall 94 and substantially conforms to the lower portion of the V-shaped locking ring 26". As a result, a major extent of the the shoulder wall 96 and the lower portion of the V-shaped locking ring 26" contact one another when a pair of such can carriers 10" are stacked (as might be needed during manufacturing and/or packaging operations) so that the stiffing flange regions 92 are separated by a defined vertical dimension D. This separation dimension D thus facilitates automated separation and/or handling of the individual can carriers 10".

As noted previously, the central platform wall 90 of the can-stacking platform 40" is vertically raised above the uppermost extent of the cover wall 32" and is thus especially adapted to fit within the recess associated with the bottoms of conventional all-aluminum can bodies. Furthermore, as indicated previously, conventional can bodies also include a tapered annular bottom region TBR (see FIG. 2). According to the can carrier 10" shown in FIGS. 10-12, therefore, the central platform wall 90 is surrounded by an annular downwardly and inwardly sloping support wall 98 which is joined to the substantially vertical side wall 90*a* of the platform 90 via an arcuately concave intermediate wall 90*b*. These walls thus form a sloped annular recessed region 100 which closely matches the taper of the bottom region TBR associated with the cans 12 so that the cans may reliably be stacked thereupon. As a result, greater stacking integrity is provided.

The D-shaped finger openings 80″ of the can carrier 10″ preferably include a pad region 84″ of the type as described above with reference to FIGS. 8 and 9. A D-shaped slot 83″ is, however, formed between the opening 80″ and its associated flap member 82″ as can be seen more clearly in FIG. 10. The D-shaped slot 83″ serves to more readily identify the corresponding D-shaped opening 80″. In addition, the D-shaped slot 83″ more easily facilitates the downward folding of the flap 82″ when a user's finger is inserted into the opening 80″.

As is now apparent, the can carriers of this invention provide advantages not realized in the prior art. Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A can carrier adapted to hold a number of cans, each can having an annular top head and a generally tapered bottom so as to allow the cans to be collectively stacked one upon the other, said can carrier comprising:

a one-piece generally planar carrier sheet having a plurality of can-stacking members upwardly protruding therefrom so as to establish a corresponding plurality of can-stacking platforms; and said can-stacking platforms having (i) an annular cover wall defining an annular locking channel closely corresponding to the top bead of a can, (ii) a central platform wall, and (iii) an annular downwardly and inwardly sloping support wall integrally joining said bottom wall to said cover wall and establishing an annular recessed region bounding said central platform wall which is sized and configured to accept therewithin the tapered bottom of another can to allow nesting with said can-stacking platform; and wherein said carrier sheet includes at least one pair of finger apertures, and generally triangular shaped pad regions extending from the plane of said carrier sheet and located adjacent said finger apertures.

2. A can carrier as recited in claim 1, wherein said can-stacking members define an M by N array, where M and N respectively represent a number of columns and rows of said can-stacking members in said array.

3. A can carrier as recited in claim 1 wherein said can carrier has a depending skirt having an upper edge which is integrally joined to said generally planar carrier sheet so as to prevent the cans being carried by said can carrier from splaying.

4. A can carrier as recited in claim 3 wherein said depending skirt has a lower edge which includes an outwardly extending peripheral flange for rigidifying said depending skirt.

5. A can carrier as recited in claim 1 wherein said apertures are centrally disposed within said generally planar carrier sheet.

6. A can carrier as recited in claim 5 wherein said apertures of said generally planar carrier sheet are D-shaped.

7. A can carrier as recited in claim 1, wherein said generally planar carrier sheet is perforated to allow individual ones of said can-stacking members to be separated physically therefrom.

8. A can carrier adapted to hold a number of cans comprising a one-piece generally planar carrier sheet which includes:

a number of can-receiving members upwardly protruding from the carrier sheet and establishing a corresponding number of can-receiving recesses which are sized and configured to removably engage, and thereby hold, a respective top of a can;

a pair of finger openings formed in said generally planar carrier sheet to allow said can carrier to be grasped manually; and generally triangular raised pad regions which are positioned laterally adjacent to respective ones of said finger openings.

9. A can carrier as in claim 8, wherein said pad regions are raised by a dimension less than a dimension established by said protruding can-receiving members.

10. A can carrier as in claim 8, wherein said pad regions include a base wall interiorly laterally adjacent said respective finger opening, and a pair of side walls joined to respective ends of said base wall and convergingly extending toward one another.

11. A can carrier as in claim 8 or 10, wherein said at least one rib element is formed on said pad region.

12. A can carrier as in claim 8 or 10, wherein said finger openings include a flap, and wherein said at least one rib element is formed on said flap.

13. A can carrier as in claim 10, wherein a plurality of said rib elements are provided, and wherein said plurality of rib elements are positioned relative to said pad region such that said rib elements radially diverge from one another from an apex juncture towards said base wall.

14. A can carrier as in claim 10 or 13, wherein said pad region includes a top wall which slopes downwardly away from said base wall.

15. A can carrier adapted to hold a number of cans, each can having an annular rolled bead joining a top wall thereof to a generally cylindrical can body and a generally tapered bottom so as to allow the cans to be collectively carried and stacked, said can carrier comprising:

a one-piece, generally planar carrier sheet having a plurality of can-receiving members upwardly protruding so as to establish a plurality of oppositely paired can-receiving recesses and can-stacking platforms, said can-receiving recesses including;

an annular locking ring; and a protective cover wall integrally joined to said locking ring and sized and configured to cover said rolled bead, said locking ring lockably engaging the can body below the rolled bead to thereby removably couple said can to said carrier sheet;

said can-stacking platforms including;

a central platform wall which is vertically raised above an uppermost extent of said cover wall;

said central platform wall being joined to said cover wall by a downwardly and inwardly sloping support wall which establishes an annular recessed region bounding said central platform wall which is sized and configured to accept therewithin said generally tapered bottom of said can.

16. A can carrier as in claim 15 which further comprises a pair of finger openings formed in said carrier sheet.

17. A can carrier as in claim 16, wherein said finger openings each include a flap which is established by a generally D-shaped slot.

18. A can carrier as in claim 16, wherein said pair of finger openings each include an raised pad region having a base wall adjacent said finger opening, said pad region sloping downwardly away from said base wall.

19. A can carrier as in claim 16, wherein said pair finger openings each include an adjacent raised pad region, and at least one rib element associated with said pad region.

20. A can carrier as in claim 19, wherein said pad regions are generally triangular and include a base wall interiorly laterally adjacent said finger opening, and a pair of side walls joined to respective ends of said base wall and convergingly extending toward one another.

21. A can carrier as in claim 19 or 20, wherein said at least one rib element is formed on said pad region.

22. A can carrier as in claim 19, wherein a plurality of said rib elements are formed on said pad region, and wherein said plurality of rib elements are positioned relative to said pad region such that said rib elements radially diverge from one another from an apex juncture towards said base wall.

23. A can carrier as in claim 15, wherein said central platform wall is joined to said sloping support wall by an arcuately concave intermediate wall.

24. A can carrier adapted to hold a number of cans comprising a one-piece generally planar carrier sheet which includes:

a number of can-receiving members upwardly protruding from the carrier sheet and establishing a corresponding number of can-receiving recesses which are sized and configured to removably engage, and thereby hold, a respective top of a can;

a pair of finger openings formed in said generally planar carrier sheet to allow said can carrier sheet to allow said can carrier to be grasped manually;

raised pad regions each adjacent a respective one of said finger openings; and at least one rib element associated with said pad regions, wherein said pad regions are generally triangular and include a base wall interiorly laterally adjacent said respective finger opening, and a pair of side walls joined to respective ends of said base wall and convergingly extending toward one another.

25. A can carrier as in claim 24, wherein said pad regions are raised by a dimension less than a dimension established by said protruding can-receiving members.

26. A can carrier as in claim 24 or 25, wherein said at least one rib element is formed on said pad region.

27. A can carrier as in claim 24 or 25, wherein said at least one rib element is formed on said flap.

28. A can carrier as in claim 24 or 25, wherein a plurality of said rib elements are provided, and wherein said plurality of rib elements are positioned relative to said pad region such that said rib elements radially diverge from one another from an apex juncture towards said base wall.

29. A can carrier as in claim 28, wherein said pad region includes a top wall which slopes downwardly away from said base wall.

30. A can carrier as in claim 24, wherein said pad region includes a top wall which slopes downwardly away from said base wall.

31. A can carrier formed from a generally planar carrier sheet which includes:

(i) a number of can-receiving members which are sized and configured to removably hold a corresponding number of cans;

(ii) an aperture to allow the can carrier to be carried thereby, and (iii) a triangular-shaped pad region extending outwardly from said planar carrier sheet and positioned closely adjacent to said aperture.

32. A can carrier as in claim 31, wherein said triangular-shaped pad region includes a base wall which is positioned adjacent said aperture, and a pair of side walls joined to said base wall and convergingly extending therefrom.

33. A can carrier as in claim 32, wherein said pad region slopes from said base wall to said carrier sheet.

34. A can carrier as in claim 32, 32 or 33, wherein said triangular-shaped pad region includes at least one rib element.

35. A can carrier as in claim 31, 32 or 33, wherein said triangular-shaped pad region includes a plurality of rib elements which radially diverge from one another.

36. A can carrier as in claim 31, wherein said aperture includes an integral flap.

37. A can carrier as in claim 31, wherein said triangular pad region includes a base wall, and wherein said triangular pad region slopes from said base wall to said carrier sheet.

38. A can carrier as in claim 31, wherein carrier sheet includes at least one pair of said apertures and at least one pair of said triangular-shaped pad regions, each said pad region being positioned adjacent a respective one of said apertures.

* * * * *

UNITED STATES PATENT AND TRADEMARK OFFICE

CERTIFICATE OF CORRECTION

PATENT NO. : 5,285,892
DATED : February 15, 1994
INVENTOR(S) : Arthur E. ADAMI, Christopher P. AMBERG, William B. PENDERGRASS

It is certified that error appears in the above-identified patent and that said letters patent is hereby corrected as shown below:

Column 10, line 30, delete "said"
line 33, delete "said"

Signed and Sealed this

Twenty-eighth Day of May, 1996

*Attest:*

Bruce Lehman

BRUCE LEHMAN

*Attesting Officer*

*Commissioner of Patents and Trademarks*